US007025611B2

(12) United States Patent
Leighton

(10) Patent No.: US 7,025,611 B2
(45) Date of Patent: Apr. 11, 2006

(54) CONNECTION DEVICE

(75) Inventor: Gerald Winston Leighton, Aldridge (GB)

(73) Assignee: Group 3 Technology Limited, (GB)

( * ) Notice: Subject to any disclaimer, the term of this patent is extended or adjusted under 35 U.S.C. 154(b) by 125 days.

(21) Appl. No.: 10/473,098

(22) PCT Filed: Mar. 12, 2002

(86) PCT No.: PCT/GB02/01122

§ 371 (c)(1),
(2), (4) Date: Feb. 13, 2004

(87) PCT Pub. No.: WO02/080312

PCT Pub. Date: Oct. 10, 2002

(65) Prior Publication Data

US 2004/0127082 A1 Jul. 1, 2004

(30) Foreign Application Priority Data

Mar. 28, 2001 (GB) ..... 0107720

(51) Int. Cl.
*H01R 13/00* (2006.01)

(52) U.S. Cl. ..... 439/188; 200/51 R

(58) Field of Classification Search ..... 439/188
See application file for complete search history.

(56) References Cited

U.S. PATENT DOCUMENTS

| | | | | |
|---|---|---|---|---|
| 4,387,282 | A * | 6/1983 | Latasiewicz | 200/343 |
| 5,802,170 | A * | 9/1998 | Smith et al. | 379/412 |
| 6,410,869 | B1 * | 6/2002 | McNutt | 200/51 R |
| 6,608,264 | B1 * | 8/2003 | Fouladpour | 200/51.03 |
| 2004/0127082 | A1 * | 7/2004 | Leighton | 439/188 |

FOREIGN PATENT DOCUMENTS

| | | |
|---|---|---|
| EP | 0487893 | 6/1992 |
| GB | 2286925 | 8/1995 |

OTHER PUBLICATIONS

International Search Report May 21, 2002.

* cited by examiner

*Primary Examiner*—James R. Harvey
(74) *Attorney, Agent, or Firm*—Ira S. Dorman

(57) ABSTRACT

A device for providing communication between an output connection (3) and either an input connection (1) or an override socket (8), characterised in that the device has a first state in which the override socket (8) is empty, the input connection (1) being connected to the output connection (3), and a second state in which the input connection (1) is disconnected from the output connection (3), the override socket (8) being connected to the output connection (3). The device is toggled between the first and second states by insertion/removal of an override plug (9) into/from the override socket (8) respectively.

18 Claims, 5 Drawing Sheets

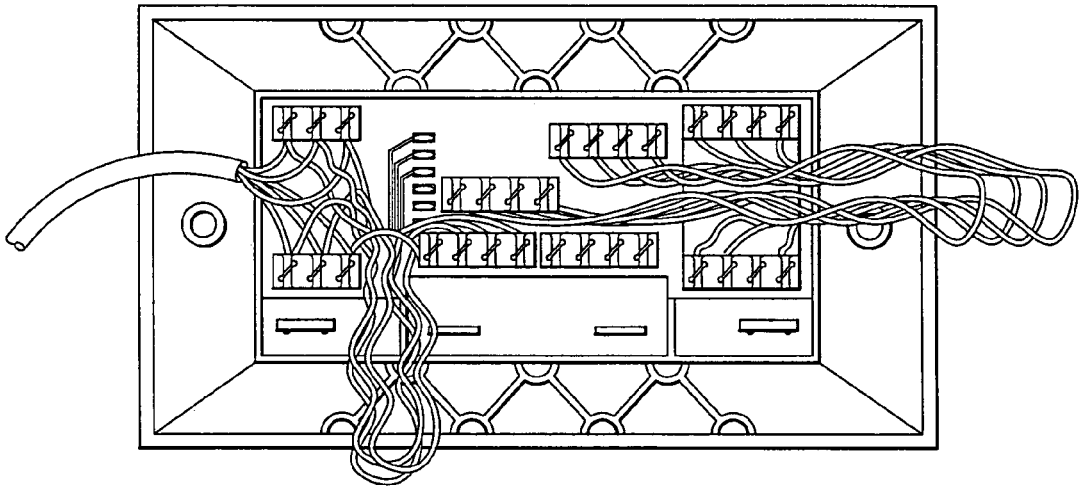
FIG 4
FIG 5
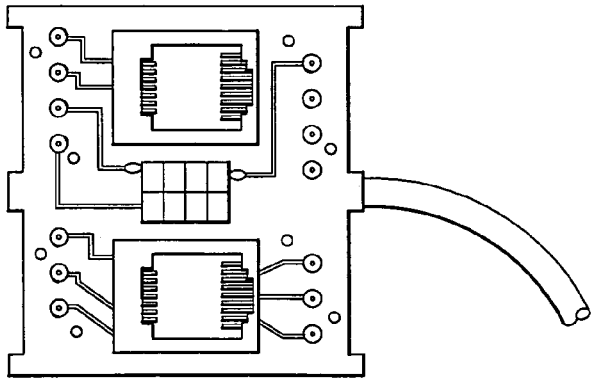

CONNECTION DEVICE

This invention relates to a connection device. In particular, this invention relates to a connection device which automatically disconnects an input connection from an output connection when an override plug is inserted into an override socket. The invention particularly relates to such a device that operates without the need for a power source.

In many fields, communication between different devices is conveniently effected by means of a plug and socket connection. A telephone, for example, is commonly provided with a plug which may be plugged into one of a number of telephone sockets, thereby providing connection of the telephone to a PBX, for example. It is also known to provide "piggy back" type sockets, in which one plug is provided with an integral socket, so that the user may plug in two devices into the same main socket simultaneously. However, in some circumstances, a user may wish to plug a second device into a socket instead of (not in addition to) a first device. The simplest way of doing this is for the user to unplug the first device and to plug in the second device. An example of such a situation occurs in the field of telephone exchanges. An engineer might wish to perform maintenance on the telephone exchange without interference from the telephone system. The engineer unplugs the telephone system's master plug from the exchange and inserts the plug of a control device, such as a laptop computer. After finishing the maintenance operation, the engineer would then unplug his control device and reinsert the master plug. However, should the engineer forget to reinsert the master plug, the telephone system would not work. This is a fairly frequent occurrence in this sort of application.

There is therefore a requirement for a system that avoids the above disadvantages. In particular, there is a requirement for a system which automatically disconnects a first input connection from an output connection when a plug is inserted. There is also a requirement for such a system which automatically reconnects the first input connection to the output connection when the said plug is removed. There is a further requirement for such a system which does not require a power source in order to operate.

It is an object of the present invention to fulfil the above requirements.

According to the above object, the invention provides a device for providing communication between a plurality of connectors of an output connection and either a plurality of connectors of an input connection or an override socket, in which the device has a first state in which the override socket is empty, the input connection being connected to the output connection, and a second state in which the input connection is disconnected from the output connection, the override socket being connected to the output connection, the device being toggled between the first and second states by insertion/removal of an override plug into/from the override socket respectively, wherein the input connection is connected to the output connection by user-configurable connection means.

Disconnection/connection of the input connection and the output socket may be actuated mechanically by insertion/removal of the override plug. Further, the disconnection/connection may be accomplished by means of one or more switches, each switch being mechanically actuated by insertion/removal of the override plug.

At least some of the input connectors of the input connection may have an electrical connection path to a corresponding output connector or the output connection, a switch being provided in each path, disconnection/connection of each input connector and output connector being accomplished by means of the switch. A bank of switches may be provided, opening/closing of the bank of switches being actuated by insertion/removal of the override plug.

The input connection may include an input socket, an input plug being insertable into the socket so as to be electrically connected thereto. The input plug may be provided with a plurality of input plug contacts, the input socket being provided with a plurality of input socket contacts, at least some of the input socket contacts co-operating with a corresponding contact on the input plug so as to form an electrical connection thereto.

The user-configurable connection means may comprise first user-configurable connection means provided between the input connection and the switches so that a user may select which input contact is to be connected to which switch. Alternatively or additionally, the user-configurable connection means may comprise second user-configurable connection means provided between the switches and the output connection so that a user may select which switch is to be connected to which output connector.

For a better understanding of the present invention and to show more clearly how it may be carried into effect reference will now be made, by way of example, to the accompanying drawings which show schematically various embodiments of the present invention. The figures are not to scale. In the drawings:

FIG. 4 is a similar view to that of FIG. 3, but with the devices of FIGS. 2 and 3 shown mounted next to a standard PCB and with jumper leads inserted;

FIG. 5 is a top view of another embodiment of a device according to the present invention;

Figure 1:
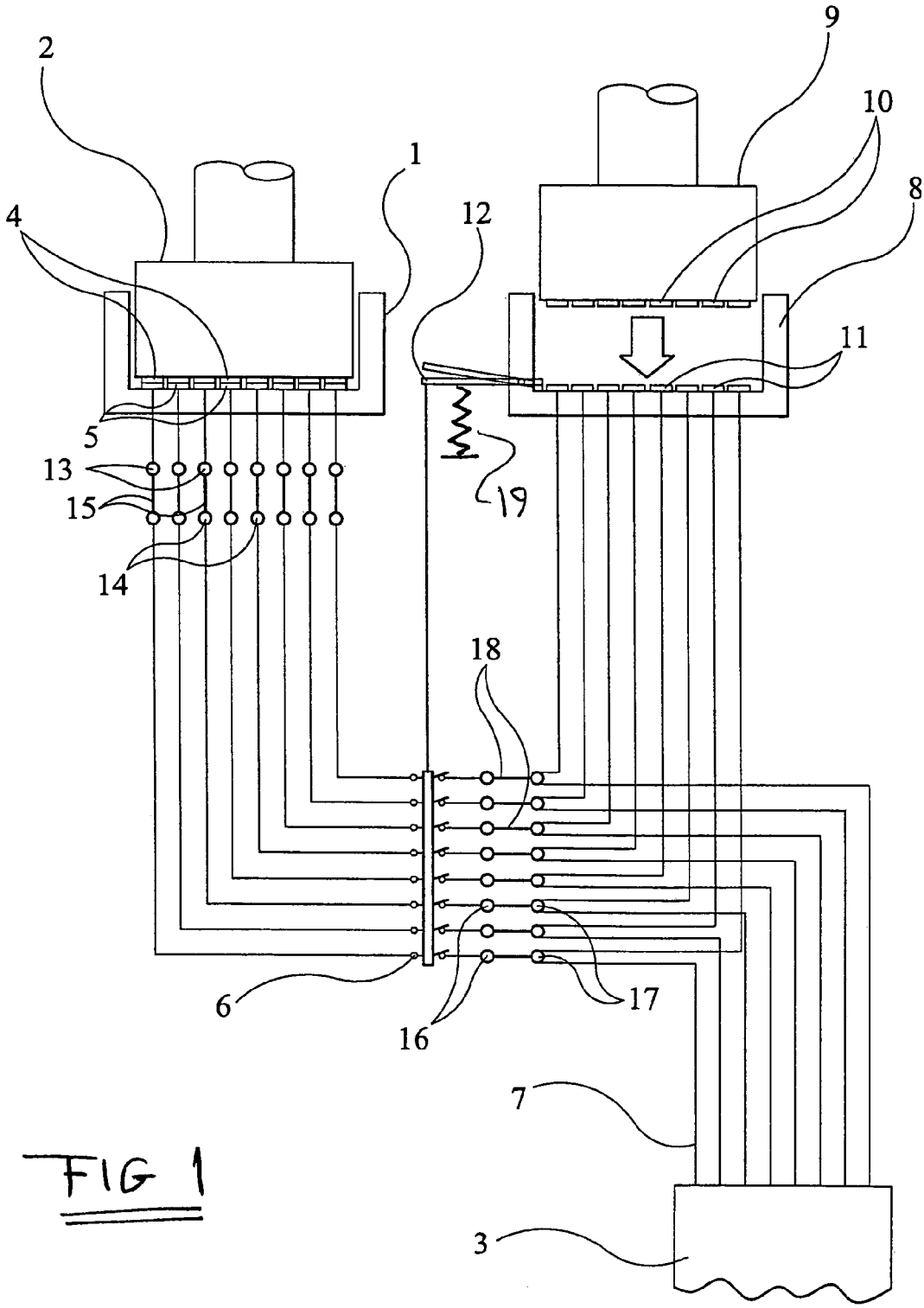
FIG. 1 shows one embodiment of a connection device according to the present invention.

In FIG. 1, a connection device includes an input socket 1, into which in normal operation an input plug 2 is inserted. The input socket 1 has an electrical connection path (via a number of components which will be described below) to an output connection comprising an output cable 3. The input plug 2 has a number (in this case eight) of input plug contacts 4 which, on proper insertion of the input plug 2 into the input socket 1 co-operate with corresponding input socket contacts 5. Each input socket contact 5 is connected, via a switch 6, to a corresponding one of a number of output connectors 7 which together form the output cable 3.

The connection device is also provided with an override socket 8 into which an override plug 9 may be inserted. The override plug and socket are provided with override plug contacts 10 and socket contacts 11 respectively. Each override socket contact is also connected to a corresponding output connector 7 of the output cable 3. The override socket 8 is additionally provided with a pivoted lever 12, which is con-nected via a mechanical linkage to the bank of switches 6. Upon proper insertion of an override plug 9 into the override socket 8, the lever 12 is depressed, which causes the bank of switches 6 to be opened, breaking the connection between the input socket 1 and the output cable 3. Each contact 10 of the override plug 9 now has an electrical contact path to the corresponding one of the output connectors 7. Removal of the override plug 9 allows the lever 12 to return to its original state, closing the switches 6 and again connecting the input socket 1 to the output cable 3. Means, such as a spring 19, may be provided to bias the lever 12 to its original position in the absence of the override plug 9. The lever 12 may be replaced by any other suitable means such as a cam or similar in order to actuate opening/closing of the bank of switches 6 on insertion/removal of the override plug.

In this embodiment, user-configurable means 13, 14, 15 are provided so that the user can select which particular input socket contact 5 is connected to a particular one of the bank of switches 6. The input socket contacts 5 are each connected to a corresponding first jumper contact 13. The input side of each switch in the bank of switches 6 is similarly connected to a corresponding second jumper contact 14. Each first jumper contact 13 may be connected to a selected second jumper contact 14 by means of one of a set of first jumper leads 15. The user may connect the first and second jumper contacts in any desired configuration, and may also connect two or more first jumper contacts 13 (or similarly second jumper contacts 14) together.

Further user-configurable means 16, 17, 18 are similarly shown between the output side of the switches 6 and the corresponding override socket contacts 11. In the embodiment shown in FIG. 1, the output side of each switch 6 is connected to a corresponding third jumper contact 16. A corresponding set of fourth jumper contacts 17 is provided, each connected both to the corresponding override socket contact 11 and to a corresponding output connector 7 respectively. Connection between the third 16 and fourth 17 jumper contacts is again made via a set of second jumper leads 18. The user may again configure the jumper leads as required, making connections between any of the first, second, third and fourth jumper contacts.

The sockets 1, 8 are typically of a standard configuration (the override socket 8 having been modified to include the lever 12) and are suitable for the insertion of standard plugs. Various of the electrical pathways may be electrical connections formed on a printed circuit board (PCB).

Various alternative embodiments of the invention are possible. For example, input plug 2 and socket 1 may be replaced by a permanent, hard-wired connection, although this configuration would not be as flexible as that shown in FIG. 1.

Figure 2:
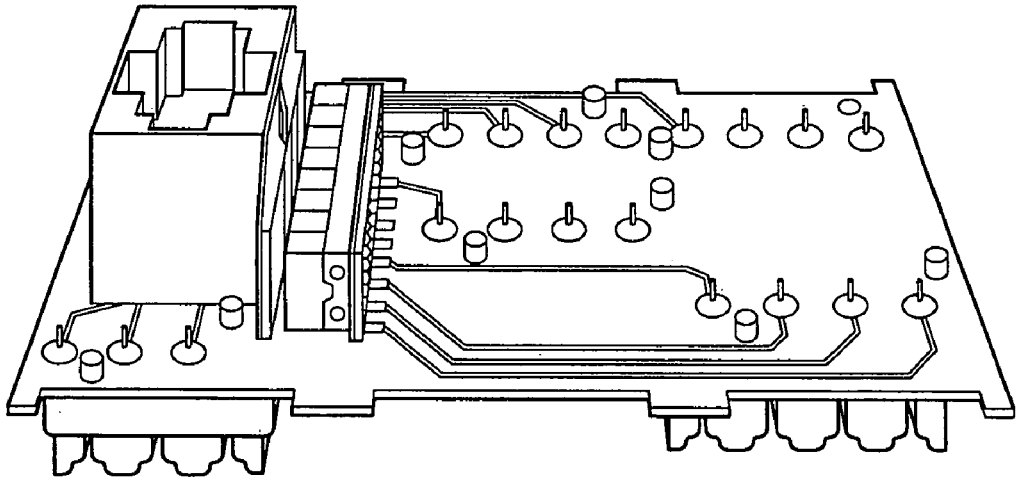
FIG. 2 is a top view of an embodiment of a device according to the present invention.
Figure 3:
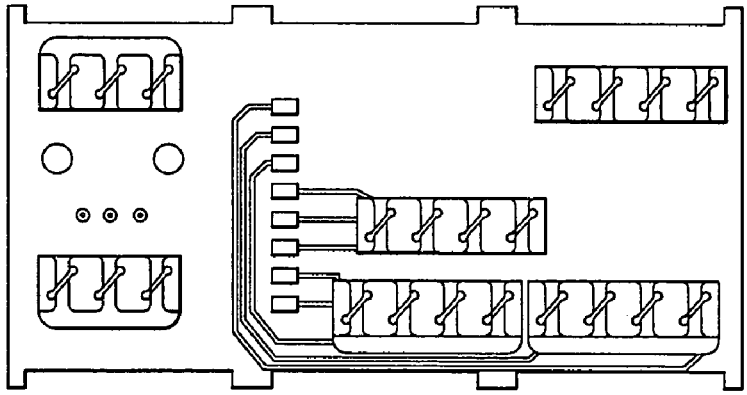
FIG. 3 is a view of the device of FIG. 2 from underneath the PCB.

FIGS. 2 to 4 show different views of an actual device according to an embodiment of the invention. FIG. 2 is a top view of the device. FIG. 3 is a view of the same device from underneath the PCB. In FIG. 3, no jumper leads are present. FIG. 4 is also a view from underneath the PCB. In FIG. 4 the device of FIGS. 2 and 3 is shown mounted next to a standard PCB upon which is mounted an input socket (not visible in FIG. 4 as the device is seen from below). In FIG. 4, jumper leads have been inserted.

Looking now at FIGS. 2 to 4, the device consists of a specially designed printed circuit board (PCB), upon which is mounted an override socket and a bank of switches. The override socket is provided with a lever (see particularly FIG. 2) arranged so that movement of the lever moves the pins so as to actuate the switches, as described above. The lever moves when a plug is inserted into the override socket.

The override socket is a standard socket which has a section removed so that the lever can open the switches when the socket is used. The example in FIG. 2 shows an RJ11 connector that only uses six wires, but the principle would be the same for any number of wires. In this embodiment, the PCB is designed to be the size of a standard 3-socket PCB. The overall device will therefore fit inside a 4-socket enclosure. The switching mechanism is a mechanical micro switch that opens eight switches on the printed circuit board (PCB) when a plug is inserted into the override socket. The switch is mechanical so that no extra power is required on the printed circuit. This embodiment is very similar to that shown in diagrammatic form in FIG. 1, in that each socket is connected to the switch bank via a jumper lead arrangement so that the user can specify the exact wiring. For example, the user may wish to swap two wires over on one socket. Alternatively, the user may wish to connect two wires (for example the power and earth wires) from both sockets together. It is worth noting that not all the connector pads need be used. The number of connector pads used for each socket depends on user requirements for achieving continuous signalling and/or switching purposes.

On the underside of the PCB there are provided three sets of connector pads: one set for the override socket and two sets for the bank of switches; one set for each side of the bank of switches (see FIG. 4). The user physically inserts jumper leads so as to wire the input socket PCB to the specially designed PCB to suit his particular requirements.

Another embodiment of the device will now be described with reference to FIGS. 5 to 9.

Figure 6:
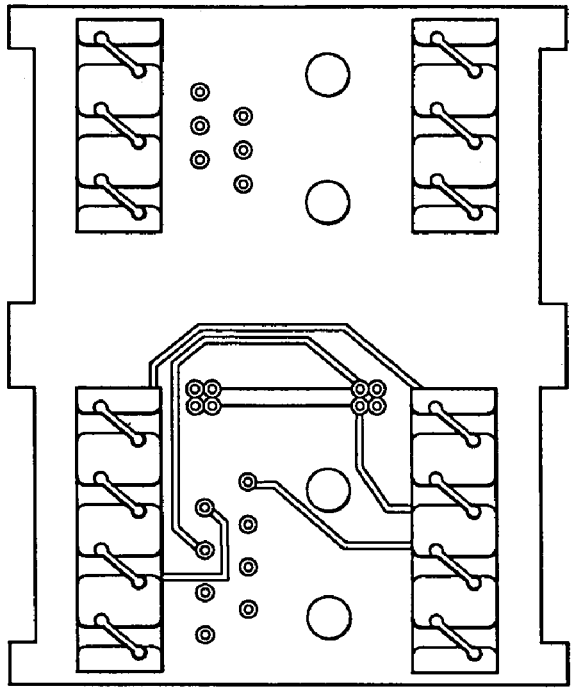
FIG. 6 is a view from underneath the PCB of FIG. 5.
Figure 7:
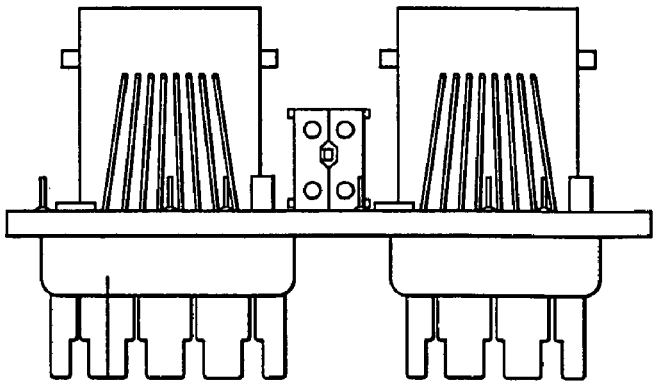
FIG. 7 is a side view of the device of FIG. 5.
Figure 8:
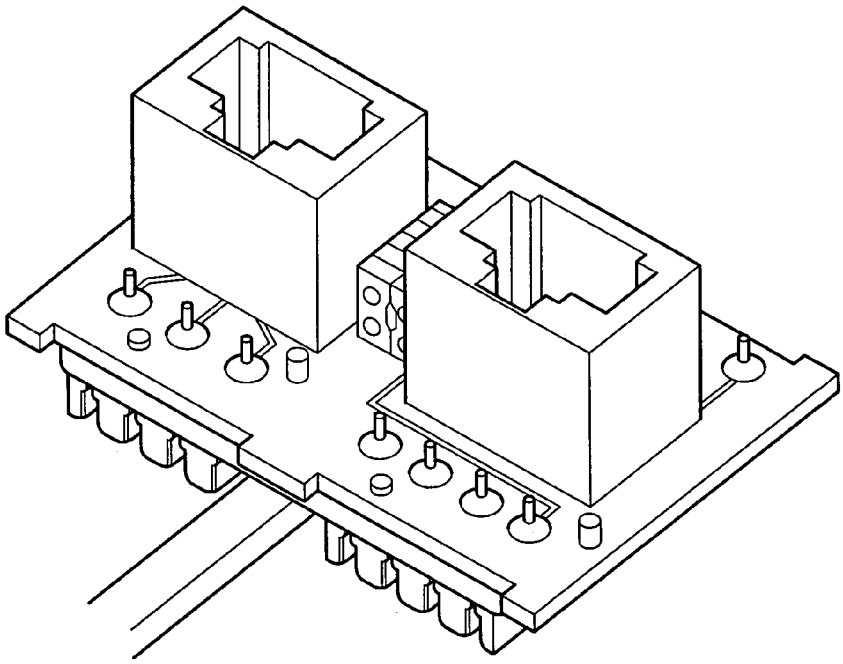
FIG. 8 is a perspective view of the device of FIG. 5.
Figure 9:
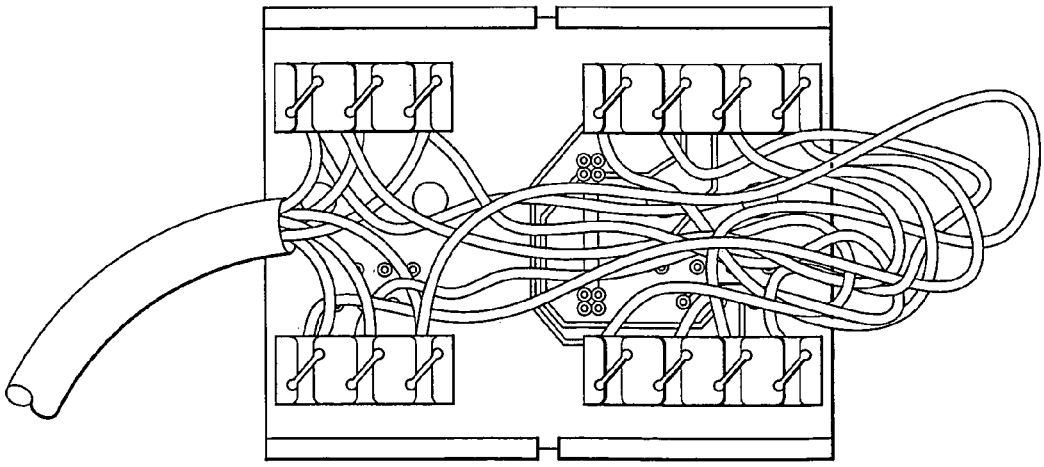
FIG. 9 is a view similar to that of FIG. 6, but with jumper leads inserted.

FIG. 5 shows a top view of another embodiment of the invention. FIG. 6 shows a view from underneath the PCB of FIG. 5. FIG. 7 is a side view of the device of FIG. 5. FIG. 8 is a perspective view of the same device. FIG. 9 is a view similar to that of FIG. 6 but with jumper leads inserted.

It is worth noting that the socket types in either embodiment may be chosen by the user and wired into the device. Even the number of switches is not entirely fixed. In the embodiment of FIGS. 5 to 9, four switches are attached to the device but the switching mechanism can be altered to prevent any number of the switches from being opened.

The device is made up of a printed circuit board, on which are provided an input socket, an override socket and a bank of switches. The override socket is provided with a lever which is mechanically connected to a number of pins that activate the individual switches. In this particular embodiment, the input socket is an RJ45 8-wire female socket and the override socket is an RJ11 6-wire female socket. The cable is a 6-wire cable. Because of physical size restraints in this particular realisation, only four switches have been provided. In this embodiment, the switches are hard wired to the input socket contacts.

The switching mechanism is a mechanical micro switch that has the possibility of opening up to four switches on the printed circuit board (PCB) when a connector plug is inserted into the override socket.

In this device, it is worth noting that an RJ45 connector uses an 8-wire cable whereas the RJ11 connector uses a 6-wire cable. Two of the wires on the RJ45 are not used and therefore are not connected to the cable (they are in fact strapped together).

The mechanical switch sits between the RJ11 socket and the RJ45 socket on a vertical PCB (see particularly FIG. 7 and also FIG. 2 in respect of the previous embodiment). The lever is attached to a set of pins that are aligned in such a manner that when the lever moves the pins actuate the switches, i.e. open the switches. The lever moves when an RJ11 plug is inserted into the override socket. This causes the micro switches (as shown on FIG. 6 physically underneath the RJ45 component) to be opened and thus disconnecting the RJ45 socket. The removal of the RJ11 plug causes the lever to move the pins from the switches thus closing the switches.

FIG. 9 shows how the user can wire the sockets together and to cable out to an RJ11 connector. The device has been designed for flexibility so that any desired wiring pattern can be achieved.

The invention is particularly suitable for use with a system for connecting a computer network to a PBX as shown in our copending UK patent application No. 0107721.3. The invention however has utility in a wide number of fields.

The invention claimed is:

1. A device for providing communication between a plurality of connectors of an output connection (3) and one of a plurality of connectors of an input connection (1) and an override socket (8), in which the device has a first state in which the override socket (8) is empty, the input connection (1) being connected to the output connection (3), and a second state in which the input connection (1) is disconnected from the output connection (3), the override socket (8) being connected to the output connection (3), the device being toggled between the first and second states by insertion/removal of an override plug (9) into/from the override socket (8) respectively, wherein at least some of the input connectors of the input connection have an electrical connection path to a corresponding output connector of the output connection (3), a switch (6) being provided in each path, disconnection/connection of each input connector and output connector being accomplished by means of the switch, and wherein the input connection (1) is connected to the output connection (3) by user-configurable connection means (13, 14, 15) in the form of first user-configurable connection means (13, 14, 15) provided between the input connection (1) and the switches (6) so that a user may select which input contact (5) is to be connected to which switch (6).

2. A device as claimed in claim 1, wherein disconnection-/connection of the input connection (1) and the output connection (3) is actuated mechanically by insertion/removal of the override plug (9).

3. A device as claimed in claim 2, wherein each switch (6) is mechanically actuated by insertion/removal of the override plug (9).

4. A device as claimed in claim 1, wherein the input connection includes an input socket (1), an input plug (2) being insertable into the socket (1) so as to be electrically connected thereto.

5. A device as claimed in claim 4, wherein the input plug (2) is provided with a plurality of input plug contacts (4), the input socket (1) being provided with a plurality of input socket contacts (5), at least some of the input socket contacts (5) co-operating with a corresponding contact (4) on the input plug (2) so as to form an electrical connection thereto.

6. A device as claimed in claim 1, wherein a bank of switches (6) is provided, opening/closing of the bank of switches (6) being actuated by inser-tion/removal of the override plug (9).

7. A device as claimed claim 1, wherein the switches (6) are adapted to be opened and closed by means of levers (12).

8. A device as claimed in claim 7, wherein means is provided to bias the levers (12) to a position in which the switches (6) are closed in the absence of the override plug (9).

9. A device as claimed in claim 8, wherein the biasing means comprises a spring.

10. A device for providing communication between a plurality of connectors of an output connection (3) and one of a plurality of connectors of an input connection (1) and an override socket (8), in which the device has a first state in which the override socket (8) is empty, the input connection (1) being connected to the output connection (3), and a second state in which the input connection (1) is disconnected from the output connection (3), the override socket (8) being connected to the output connection (3), the device being toggled between the first and second states by insertion/removal of an override plug (9) into/from the override socket (8) respectively, wherein at least some of the input connectors of the input connection have an electrical connection path to a corresponding output connector of the output connection (3), a switch (6) being provided in each path, disconnec-tion/connection of each input connector and output connector being accomplished by means of the switch, and wherein the input connection (1) is connected to the output connection (3) by user-configurable connection means (16, 17, 18) in the form of second user-confi-gurable connection means (16, 17, 18) provided between the switches (6) and the input connection (1) so that a user may select which switch (6) is to be connected to which output connector (7).

11. A device as claimed in claim 10, wherein disconnection/connection of the input connection (1) and the output connection (3) is actuated mechanically by insertion/removal of the override plug (9).

12. A device as claimed in claim 11, wherein each switch (6) is mechanically operated by insertion/removal of the override plug (9).

13. A device as claimed in claim 10, wherein the input connection includes an input socket (1), an input plug (2) being insertable into the socket (1) so as to be electrically connected thereto.

14. A device as claimed in claim 13, wherein the input plug (2) is provided with a plurality of input plug contacts (4), the input socket (1) being provided with a plurality of input socket contacts (5) co-operating with a corresponding contact (4) on the input plug (2) so as to form an electrical connection thereto.

15. A device as claimed in claim 10, wherein a bank of switches (6) is provided, opening/closing of the bank of switches (6) being actuated by insertion/removal of the override plug (9).

16. A device as claimed in claim 10, wherein the switches (6) are adapted to be opened and closed by means of levers (12).

17. A device as claimed in claim 16, wherein means is provided to bias the levers (12) to a position in which the switches (6) are closed in the absence of the override plug (9).

18. A device as claimed in claim 17, wherein the biasing means comprises a spring.

* * * * *